US007455629B2

(12) United States Patent
Abelbeck

(10) Patent No.: US 7,455,629 B2
(45) Date of Patent: Nov. 25, 2008

(54) EXERCISE DEVICE WITH A SAFETY LOCK

(75) Inventor: Kevin G. Abelbeck, Addison, TX (US)

(73) Assignee: The Brinkmann Corporation, Dallas, TX (US)

( * ) Notice: Subject to any disclaimer, the term of this patent is extended or adjusted under 35 U.S.C. 154(b) by 400 days.

(21) Appl. No.: 11/122,358

(22) Filed: May 5, 2005

(65) Prior Publication Data

US 2006/0252609 A1 Nov. 9, 2006

(51) Int. Cl.
*A63B 21/00* (2006.01)

(52) U.S. Cl. ..... 482/92; 482/101; 482/110

(58) Field of Classification Search ..... 482/92–98
See application file for complete search history.

(56) References Cited

U.S. PATENT DOCUMENTS 3,647,209 A * 3/1972 La Lanne ..... 482/103
3,998,100 A 12/1976 Pizatella et al.
4,540,171 A * 9/1985 Clark et al. ..... 482/98
4,720,099 A * 1/1988 Carlson ..... 482/133
4,750,739 A * 6/1988 Lange ..... 482/104
5,108,354 A * 4/1992 Becker ..... 482/104
5,667,460 A * 9/1997 Smith ..... 482/8
5,935,048 A * 8/1999 Krull ..... 482/98
6,168,553 B1 * 1/2001 Kuo ..... 482/57
6,293,892 B1 * 9/2001 Slawinski et al. ..... 482/104
6,379,287 B1 * 4/2002 Slawinski et al. ..... 482/104
6,537,182 B2 * 3/2003 Slawinski et al. ..... 482/104
6,623,409 B1 * 9/2003 Abelbeck ..... 482/104
6,669,607 B2 * 12/2003 Slawinski et al. ..... 482/104
6,893,381 B2 * 5/2005 Slawinski ..... 482/8
6,926,649 B2 * 8/2005 Slawinski ..... 482/104
7,083,554 B1 * 8/2006 Lo Presti ..... 482/137
2006/0243844 A1 * 11/2006 Kosugi et al. ..... 242/374

OTHER PUBLICATIONS

Product Photo, FLEX equipment.
Product Photo, LifeFitness Equipment.
Product Photos, Muscle Dymanics Equipment.
Product Photo, Hammer Strength Equipment.

* cited by examiner

*Primary Examiner*—Lori Amerson
(74) *Attorney, Agent, or Firm*—Sheppard, Mullin, Richter & Hampton LLP

(57) ABSTRACT

A safety locking system is used on an exercise device. The locking system includes a first pawl that is mounted to a pawl shaft. The pawl shaft is movably mounted to a lock frame, which can also support a weight collar, adapted to receive weight plates to provide additional resistance to exercise. A second pawl is movably mounted to the lock frame and is connected to the first pawl by way of a spring or other bias mechanism. The lock frame limits the movement of the second pawl so as to provide a bias of the first pawl toward engagement of the pawl to a rack provided with the exercise device. The engagement of either pawl with the rack restricts movement of the lock frame in at least one direction, with gravity. If the bias spring breaks or becomes disengaged from either the first pawl or the second pawl, the second pawl is counterweighted to engage with the rack.

48 Claims, 14 Drawing Sheets

EXERCISE DEVICE WITH A SAFETY LOCK

FIELD OF THE INVENTION

The present invention generally relates to exercise equipment. More specifically, the present invention relates to safety devices used in conjunction with exercise equipment.

BACKGROUND OF THE INVENTION

Exercise equipment is quickly becoming more of a part of the daily lives of people in our fast paced and yet physically sedentary lifestyle. The basic concept of resistance or strength training appears dangerous on the surface, and in some cases it is. Effective strength training must stimulate the muscles by an "overload" or by stressing the muscles to a greater degree then they are accustomed to being stressed. This typically involves using heaver weights on subsequent training sessions. As the weight increases, the potential for injury also increases. This injury may result from stressing the muscle beyond its ability to recover (overtraining) or to accommodate a specific load (muscle strain or muscle pull). These types of injuries are usually relatively minor. In these cases the body will recover within a short period. A more serious injury type is by allowing the weight to fall and impact a portion of the user's body. This can result in severe damage to the body including permanent injury or even death. In an effort to address some of these potential problems, equipment designers have come up with products that decrease the chances of injury while allowing certain movements to be performed. One such example is a "smith machine". This machine includes an Olympic bar that allows weight plates to be received on each distal end. The bar is guided by two linear bearings or the equivalent, thus limiting the movement of the bar to one degree of freedom (substantially vertical displacement). Examples are shown of typical smith machines in the accompanied photos. The unit by LifeFitness is very standard and does not have a counterbalance to offset part of the weight of the bar. The Flex product (photo) does have a counterbalance. This allows a lighter minimum resistance for use with some exercises. The safety advantage to such a device is the linear displacement of the weighted bar. The limited freedom of movement reduces the likelihood of the bar being dropped and injuring the user.

The typical locking mechanism used includes a series of pins along the vertical rails and a pair of hooks that are mounted to the bar. The user rotates the bar to engage or disengage the hooks on the pins. When engaged, the bar hangs from the pins by way of the hooks. When disengaged, the bar is free to move, or fall. The problem is, some times the user may think the bar is hooked on the pins, when in reality it is not. The bar can be dropped and potentially severely injure the user. In other cases the user may want to engage the pins, but is not able to do so due to loosing grip with the bar, fatigue, or sustaining an injury while using the device. In each of these cases, the bar may fall and injure the user or a bystander.

The disclosed invention may also be adapted to many forms of exercise equipment and is not intended to be limited to a "smith machine" or for that matter any other linear motion device. In most cases a linear or curvilinear track is preferable and accepted in the industry. As such, these types of devices are shown for examples. Another typical device is a "hack squat" machine. Photos of typical hack squat machines from Muscle Dynamics and Hammer Strength are included for reference. These include a back support pad that is mounted to a carriage that moves relative to a base plate on which the user places their feet. The user reciprocates the movement of the carriage to exercise the muscles of the legs and hips, usually with weights added to the weight collars.

SUMMARY OF THE INVENTION

In one aspect, the invention features an exercise device including a frame supporting a track and a load rack. A lock frame supports a guide member. The guide member receives the track. A pawl shaft is articulated by a handle and the pawl shaft is received by the lock frame. A first pawl is mounted to the pawl shaft, thereby enabling selective engagement and disengagement of the first pawl with the load rack by way of the handle. A second pawl is movably mounted to the lock frame and a bias mechanism connects the first pawl to the second pawl.

The invention may also include the load rack as being a notched rack, which may be comprised of a plurality of saw-toothed notches. The track may be selected from a group including a solid shaft, a hollow tube or an open channel of virtually any shape or size. The guide member runs on the track and is a preferably a device selected from a group including a linear bearing, a bushing and a rolling element. The rolling element may include a wheel, ball bearing or a carriage roller.

The handle may be a substantially longitudinal bar that is substantially collinear with the pawl shaft. The handle may also be remote to the pawl shaft and be articulated by the handle by way of a push bar. The bias mechanism is preferably comprised of a spring. This spring may be a coil extension spring.

In one form, the device may include the load rack as being movably mounted to the frame. A base spring may be mounted to one end of the rack thereby at least partially supporting the rack on the frame and thus providing a cushion to dampen the impulse load by reducing the acceleration of a load the device would "catch". This base spring may be comprised of a compression spring that is manufactured from a material consisting of plastic, metal, natural rubber and synthetic rubber, and preferably from polyurethane.

The second pawl is preferably counterbalanced such that, in an unattended state, the second pawl is engaged with the rack. The previously noted bias member holds the second pawl in a position disengaged from the rack.

The device may also include a bumper stop releasably mounted to the rack such that it may be movably mounted to the rack along a portion of the length of the rack, thus providing an adjustable bottom most position for travel of the lock frame. The lock frame may also include a tension member, such as a cable, connected to a counterweight so as to at least partially offset the weight of the mechanism to be lifted. Finally, the device may include a weight collar adapted to receive weight plates, the collar being mounted to the lock frame.

In another aspect, the invention includes a method of exercise providing the elements of the device as noted and including the steps of grasping the handle by a user, articulating the handle to disengage the first pawl from the rack and moving the lock frame, thereby exercising the muscles of the user. In addition, the method of using the safety lock during exercise is described and includes providing the bias member to become disconnected from either of the first pawl or the second pawl and allowing the second pawl to engage with the rack, thereby limiting movement of the lock frame in at least one direction.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE INVENTION

Figure 1:
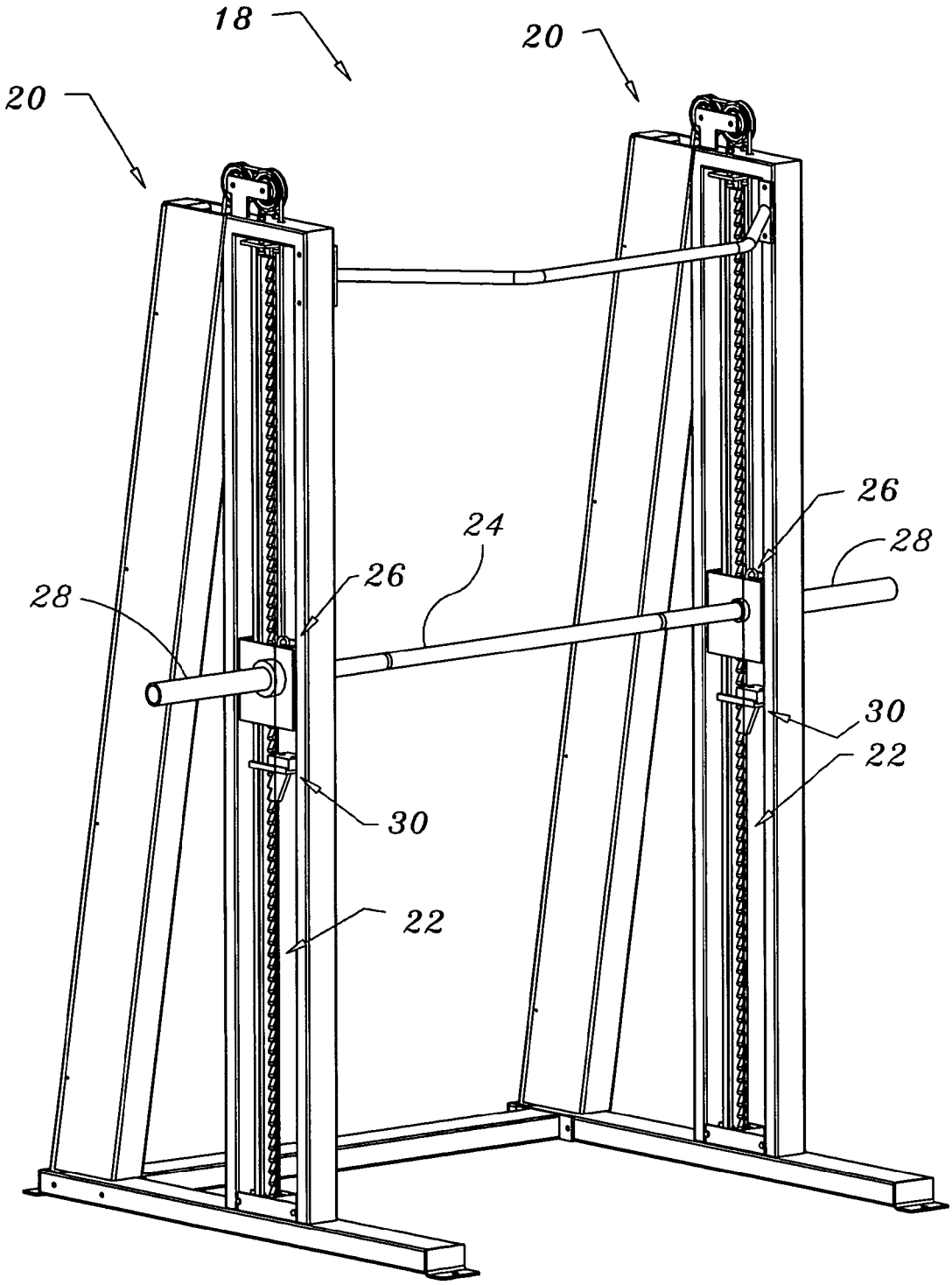
FIG. 1 is an isometric view of one form of an exercise device incorporating a safety lock produced in accordance with the present invention.

The present invention is an exercise device 18 with a safety lock mechanism. A typical example of a device 18 in the form of a smith machine is illustrated in FIG. 1. The device 18 includes two side frames 20, each with a linear component 22. Each linear component 22 includes a track and a rack which will be illustrated in greater detail later in the disclosure. A handle bar 24 is positioned between two lock frames 26, which receive one of each of the linear components 22. A weight collar 28 is mounted to each lock frame 26. This is suited for receiving one or more weight plates, thus intensifying the work done by the user during exercise provided by the displacement of the handle 24 and therefore the lock frames 26. A bumper stop 30 is also shown in that it would be provided in the preferred embodiment of the invention. These bumper stops 30 can take a variety of forms but are shown here as adjustably mounted to the linear components 22 and thus providing a lower most position of the lock frames 26 and can be vertically adjusted to suit the needs of the user.

Figure 2:
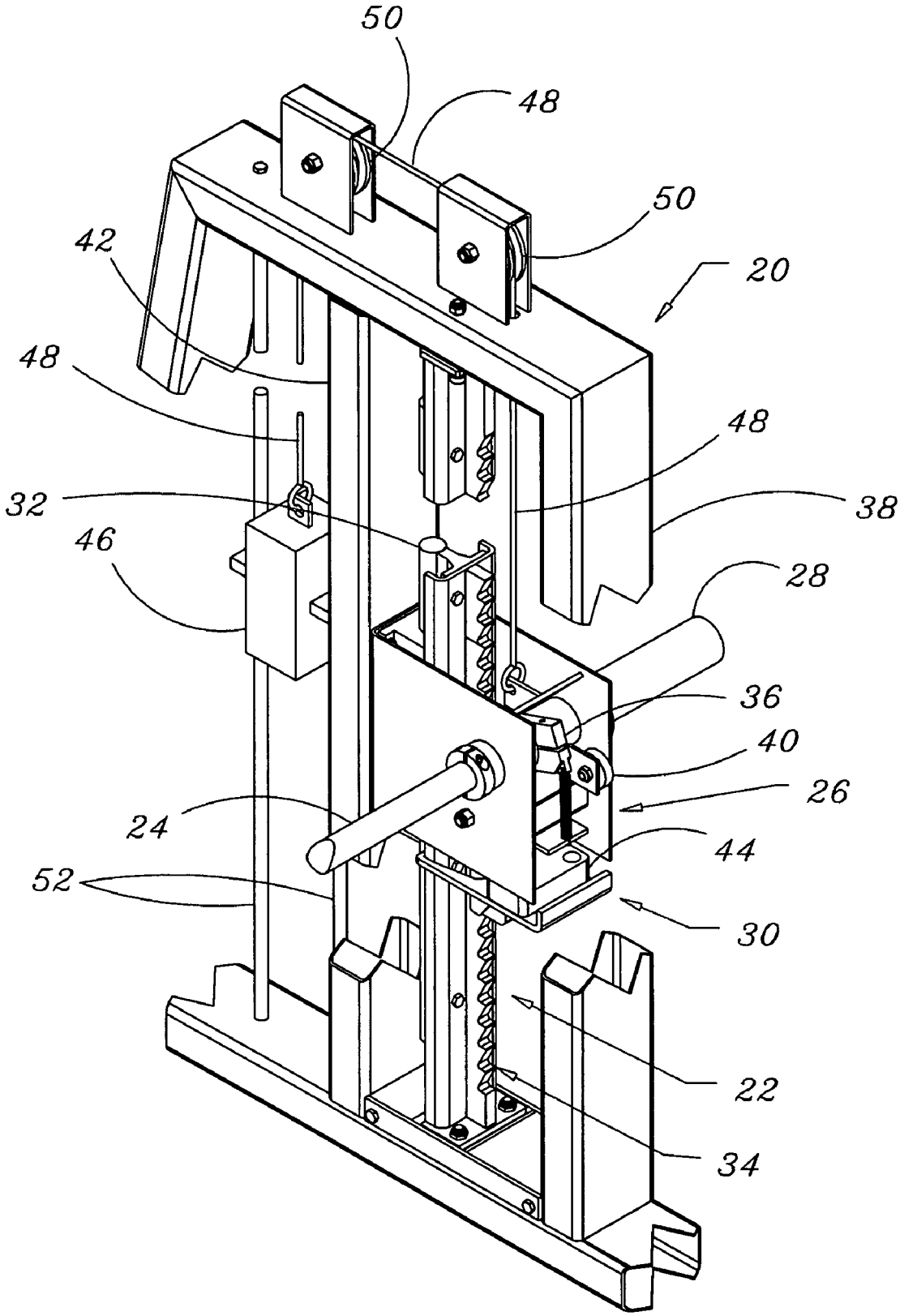
FIG. 2 is a partial isometric view of one side frame of an exercise device with a safety lock produced in accordance with the present invention.

A single side frame 20 that has been shortened and has structure removed to show critical aspects of the device is shown in FIG. 2. The handle bar 24 joins the lock frame 26 with the weight collar 28 on the opposite side of the lock frame 26. The linear component 22 is received by the lock frame 26 and is substantially orthogonal to the weight collar 28 in orientation. This is not a requirement of the invention, but is typically preferable for various design considerations and is therefore illustrated in this manner throughout the disclosure. The linear component 22 has two primary elements, a track 32 and a rack 34. The track 32 is shown here as a solid shaft used in conjunction with some type of linear bearing, rolling or sliding (a bushing). The track 32 can take the form of a hollow tube, pipe or open channel as well.

The rack is a toothed rack, and as shown here in the preferred embodiment, is a saw-toothed rack. This rack 34 has an intimate interaction with the first pawl 36 to restrict the movement of the lock frame 26. The use of the track here is also extended to the vertical tube 38 of the side frame 20. This is done through the use of a wheel 40 rotatably mounted to the lock frame 26. The wheel 40 rolls against the side of the vertical tube 38 closest to the lock frame 26, and thereby restricts the side-to-side movement of the lock frame 26. Additional wheels 40 can be positioned adjacent to other structure such as the second vertical tube 42 to further guide the movement of the lock frame 26.

The bumper stop 30 is shown here as it would be positioned just short of contact under the lock frame 26. The bumper stop 30 includes a cushion 44 to dampen the impact in the event that the lock frame 26 experienced a collision with the bumper stop 30.

An additional feature that is not critical to the novelty of the invention, but can be desirable is the use of a counterweight 46. The counterweight 46 is connected to the lock frame 26 by way of a tensile element, here a cable 48. Two pulleys 50 redirect the cable 48 to allow the counterweight 46 to offset some or all of the weight of the lock frame 26, internal components, handle bar 24 and weight collar 28. Rods 52 mounted to the side frame 20 guide the counterweight 46.

Figure 3:
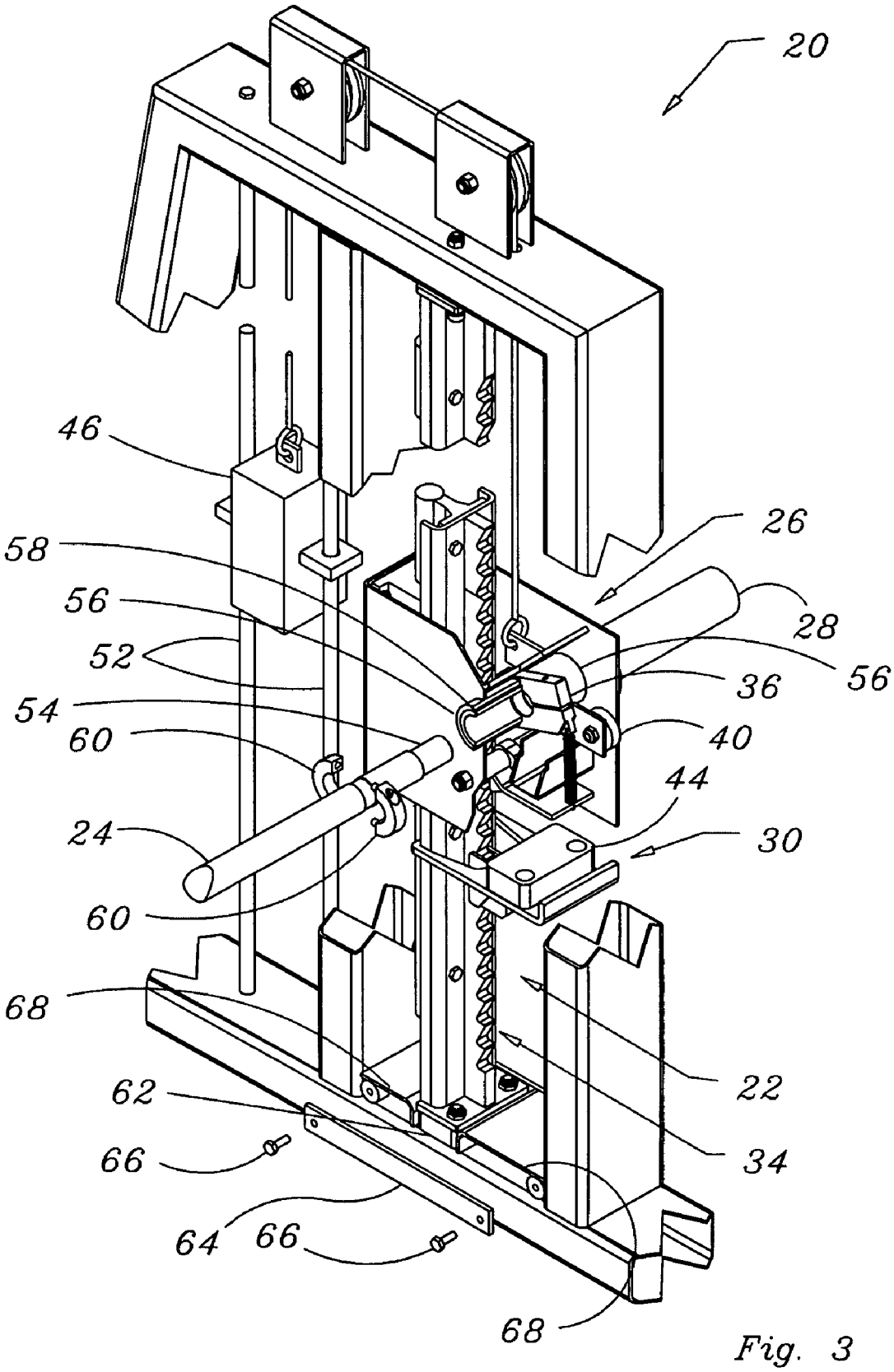
FIG. 3 is a partial isometric view of one side frame with the handle bar displaced and the lock frame partially removed to show the structure of a safety lock produced in accordance with the present invention.

Additional detail is shown in FIG. 3 in that a portion of one side of the lock frame 26 has been removed and some components displaced. The handle bar 24 has been displaced laterally to show the pawl shaft 54 at the distal end of the handle bar 24. The pawl shaft 54 is received by the first pawl 36 and secured thereto by any of a number of forms. What is disclosed involves the first pawl 36 including a split to allow for clamping of the pawl 36 onto the pawl shaft 54. In this embodiment the pawl shaft 54 is collinear with the handle bar 24 and as shown here, may be permanently connected at a distal end. In other embodiments the pawl shaft may be remote from the handle bar and connected by a linkage or other means.

The pawl shaft 54 is received by the lock frame 26 and mounted to the first pawl 36 located therein. The first pawl 36 is captured between the sleeves 56 and the pawl shaft 54 extends through and is pivotally supported by the lock frame 26 by way of the sleeves 56. Bearings 58 are received by the sleeves 56 to allow smooth rotation of the pawl shaft 54 within the lock frame 26, thereby enabling rotation of the first pawl 36. A clamp 60 is secured onto the distal ends of the handle bar 24 creating a boundary for the pawl shaft 54 and therefore the position of the handle bar 24 relative to the lock frame 26.

A base spring 62 is located on one end of the linear component 22. The base spring 62 is preferably mounted to the bottom end of the linear component 22. A spring plate 64 captures the base spring 62, thereby maintaining its side-to-side position on the frame 20. Two fasteners 66 are used to secure the plate 64 to the frame 20. The front to back position is maintained by a base structure 68, which has been adapted to limit the movement in this direction. The combination allows a boundary for the linear component 22 to move without over constraining the structure. This allows for more relaxed tolerances in manufacturing thus reducing costs and assembly problems. The function of the base spring 62 is to allow the linear component 22 to move vertically when a load is placed on the rack 34. This cushion dampens the load, thus reducing the stress on the rack 34 and pawl 36 when a heavy weight is applied rapidly, such as when the handle bar 24 is dropped while in use.

Figure 4:
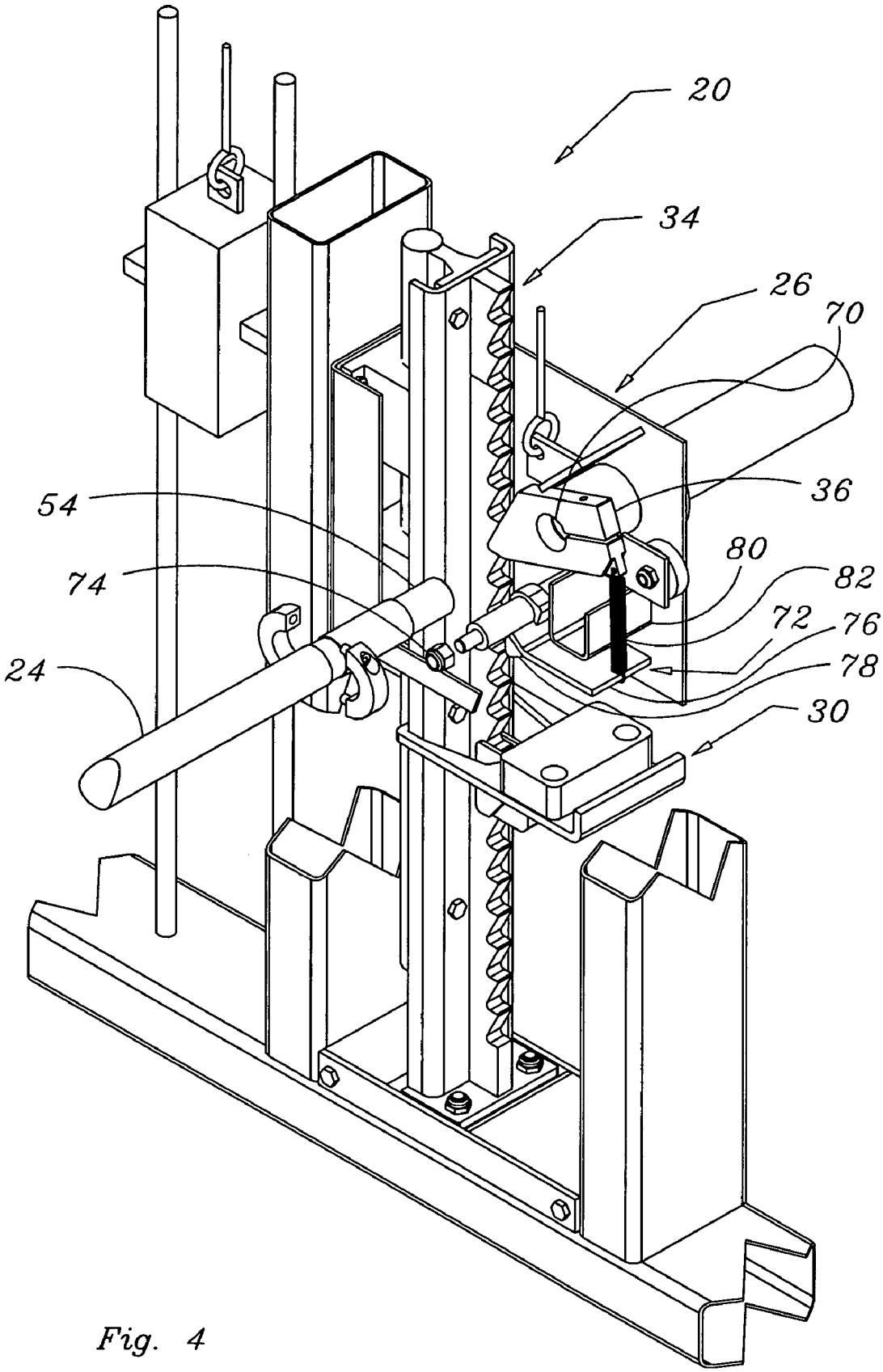
FIG. 4 is a partial isometric view of one side frame with the handle bar displaced and one side of the lock frame substantially removed to show the internal structure of a safety lock, with the primary pawl engaged, the device produced in accordance with the present invention.

A portion of one side frame 20 with one side of the lock frame 26 removed to show the internal structure, is shown in FIG. 4. The pawl shaft 54 is shown as displaced from the first pawl 36 but if in use would be received by the center orifice 70. A second pawl 72 is positioned below the first pawl 36, yet still within the lock frame 26. The second pawl 72 is pivotally mounted to the lock frame 26 by a fastener 74. The second pawl 72 includes a counterbalance plate 76 secured to the pawl portion 78. The pawl portion 78 is held away from the rack 34, and thus unlocked as long as the counterbalance plate 76 is maintained against the cross frame 80 of the lock frame 26. This position is maintained against gravity by a bias in the form of a spring 82, which connects the first pawl 36 to the second pawl 72, here at the counterbalance plate 76 of the second pawl. If the spring 82 breaks or becomes disassociated with either the first pawl 36 or the second pawl 72, the weight of the counterbalance plate will cause the second pawl 72 to rotate the pawl portion into the rack 34, engaging the lock and thus preventing the lock frame 26 from falling.

The bias spring 82 has a second purpose of biasing the first pawl 36 into engagement with the rack 34. This means that if the user releases the handle bar 24 for any reason, the spring 36 will cause the first pawl 36 to rotate into the rack 34 automatically, thus engaging the lock. As the pawl engages the teeth of the rack 34, the lock frame 26 and handle 24 are prevented from moving in one direction, down.

In this figure the first pawl 36 is engaged (locked) with the rack 34 and the second pawl 72 is not engaged (unlocked). For the purposes of this disclosure, the term "locked" will refer to the engagement of a pawl with the teeth of the rack 34, even though upward movement is still allowed. The term "unlocked" will mean that the pawl is not engaged with the rack 34. As noted, the saw-tooth design on the teeth of the rack 34 allows the pawls to engage the rack 34 to limit the downward movement but still allow upward movement. This has several advantages. First, if a spring breaks and the second pawl engages or if the user releases the handle bar 24 for any reason, the user's contact with the device (here the handle bar 24) will not experience an uncomfortable stop, such as running into a wall. The bar 24 is allowed to continue its upward movement but will not fall. The greater potential for injury would be a result of the fall, which is eliminated by the lock. In addition, many athletes desire to train by doing heavy explosive throwing movements. Jumping is throwing the body into the air and Olympic weight lifting is throwing the weighted bar into the air. The potential for injury occurs when the athlete must catch the thrown weight. Here the device catches the weight, removing that potential for injury to the athlete.

Figure 5:
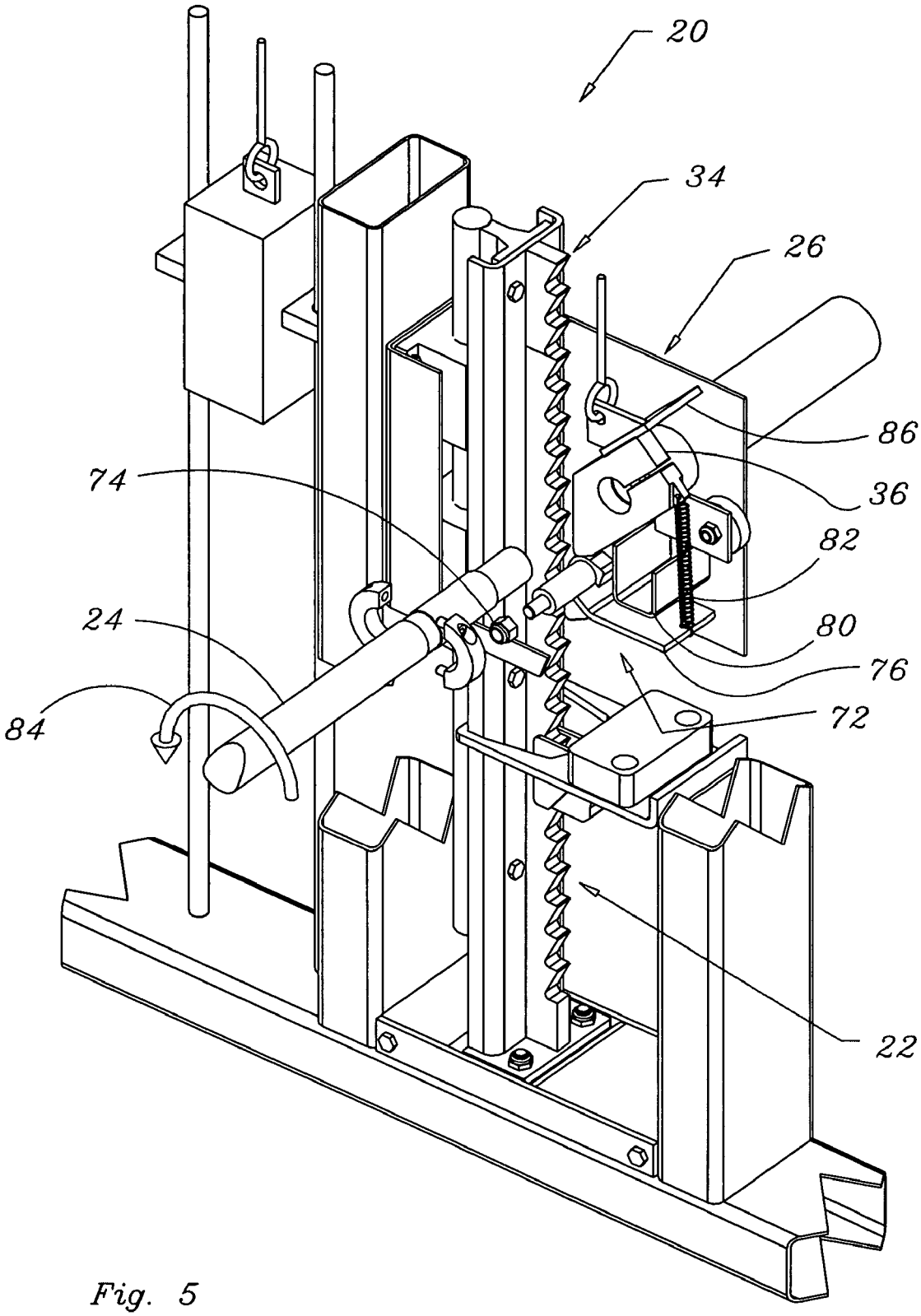
FIG. 5 is a partial isometric view of one side frame with the handle bar displaced and one side of the lock frame substantially removed to show the internal structure of a safety lock with the primary pawl disengaged, the device produced in accordance with the present invention.
Figure 6:
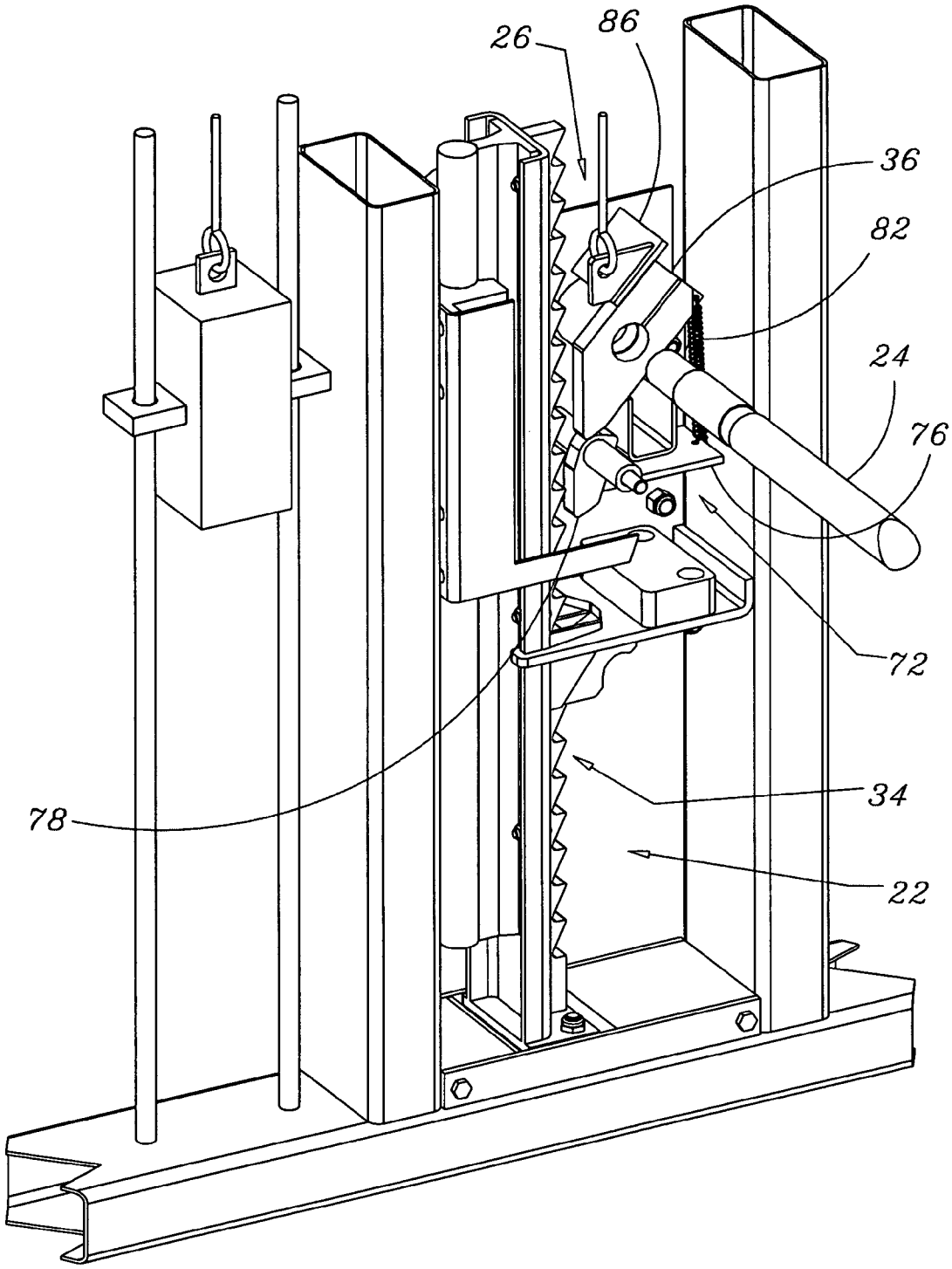
FIG. 6 is a partial isometric view of one side frame with the bar displaced and one side of the lock frame substantially removed to show the internal structure of a safety lock showing the primary pawl and secondary pawl both disengaged, the lock produced in accordance with the present invention.

When the handle bar 24 is rotated as indicated by the arrow 84, the first pawl 36 is rotated away from the rack 34 as is shown in FIGS. 5 and 6. This unlocks the first pawl 36 and allows the lock frame 26 handle bar 24 to freely move up and down the length of the linear component 22. The spring 82 extends as the second pawl 72 is limited in rotation by the cross frame 80 of the lock frame 26, thereby allowing displacement of the pawl portion 78 (FIG. 6) of the second pawl 72 from the rack 34.

The first pawl 36 has an upper stop plate 86 to limit the movement of the first pawl 36 and thereby limiting the rotation of the handle bar 24. This is done to increase the security of the grip of the user on the bar 24 and just as importantly, to prevent the spring 82 from over extending. In FIG. 6 both the first pawl 36 and the second pawl 72 are unlocked, which would be the case when a person is using the device 18.

Figure 7:
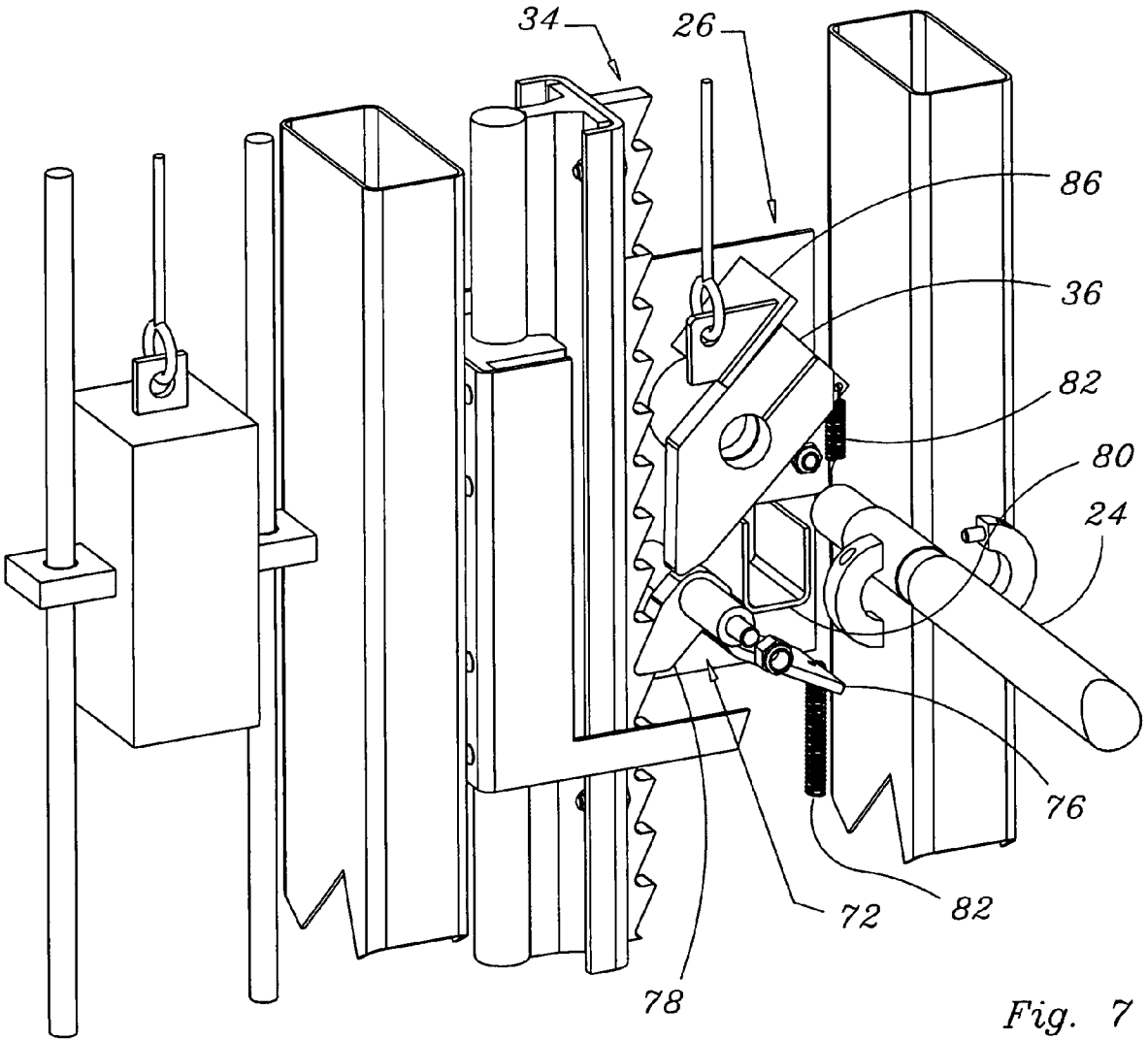
FIG. 7 is a partial isometric view of one side frame with the bar displaced and one side of the lock frame substantially removed to show the internal structure of a safety lock showing the primary pawl disengaged and secondary pawl engaged, the lock produced in accordance with the present invention.

A broken spring 82 is illustrated in FIG. 7. The first pawl 36 is still rotated (unlocked) from the rack 34 and positioned against the upper stop plate 86. This would be the case if a user was using the device 18 and the spring 82 broke or became otherwise removed from either the first pawl 36 or the second pawl 72. The weight of the counterbalance plate 76 causes the second pawl 72 to rotate the pawl portion 78 into the rack 34 thus locking the unit. Again, due to the saw-toothed teeth of the rack 34, the handle bar 24 and lock frame 26 would be able to continue to move upward to progressively higher teeth on the rack 34, but cannot move back down until the spring 82 is replaced. Replacing the spring would position the counterbalance plate 76 against the cross frame 80 and release the pawl portion 78 from the rack 34.

Figure 8:
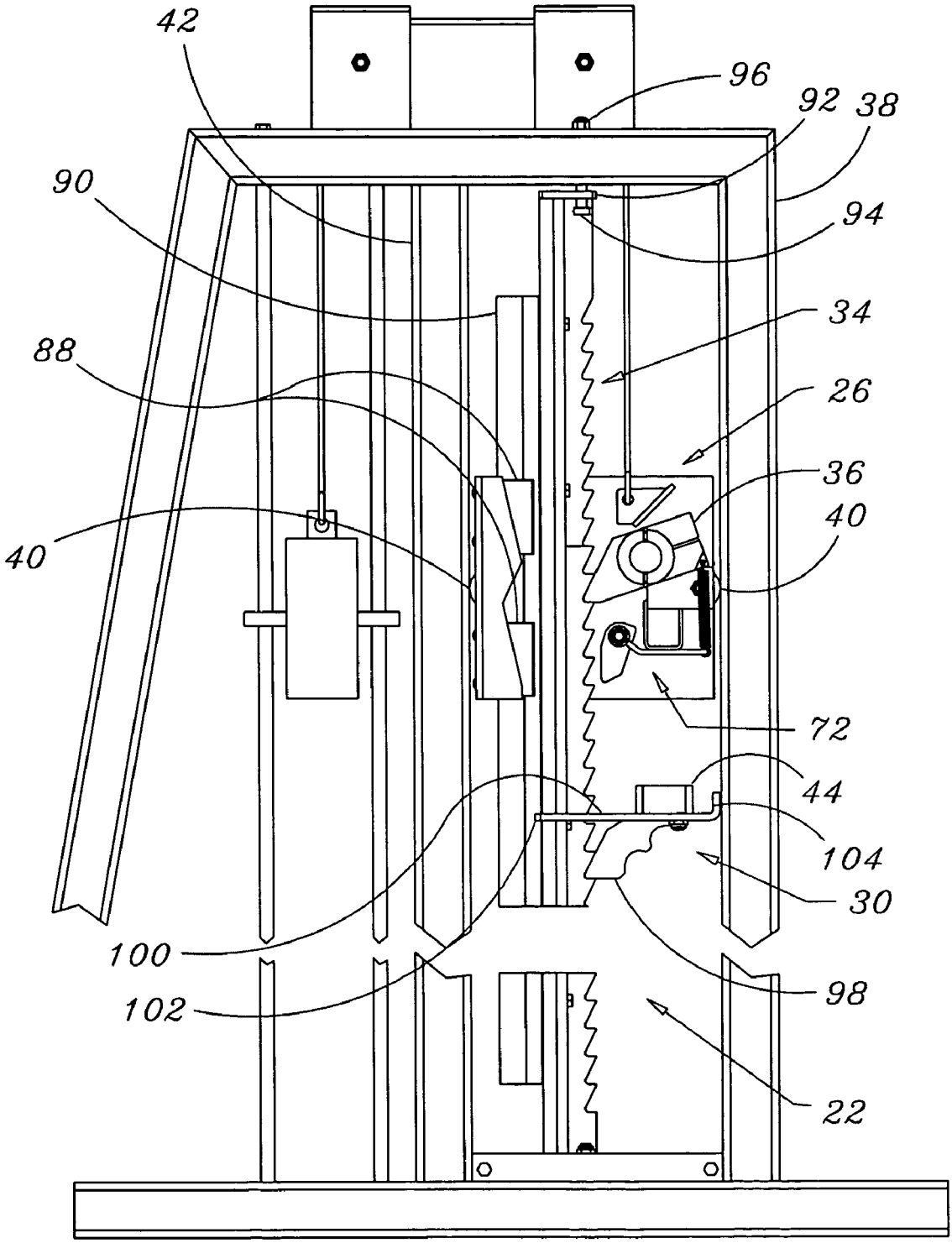
FIG. 8 is a partial side view of one side frame with one side of the lock frame substantially removed to show the internal structure of a safety lock showing the primary pawl engaged and the secondary pawl disengaged, the lock produced in accordance with the present invention.

A side view of a shortened version of a side frame 20 is shown in FIG. 8 with the side of the lock frame 26 removed to show some of the mechanism. The lock frame 26 supports the first pawl 36, shown in a locked position, and a second pawl 72 shown in an unlocked position. One version of the guide member is a linear bearing 88, which runs on the track, shown in the form of a bearing shaft 90. The shaft 90 is received by the linear bearings 88. This provides a secure movement that is also assisted by the wheels 40 against the first vertical tube 38 and the second vertical tube 42.

Figure 9:
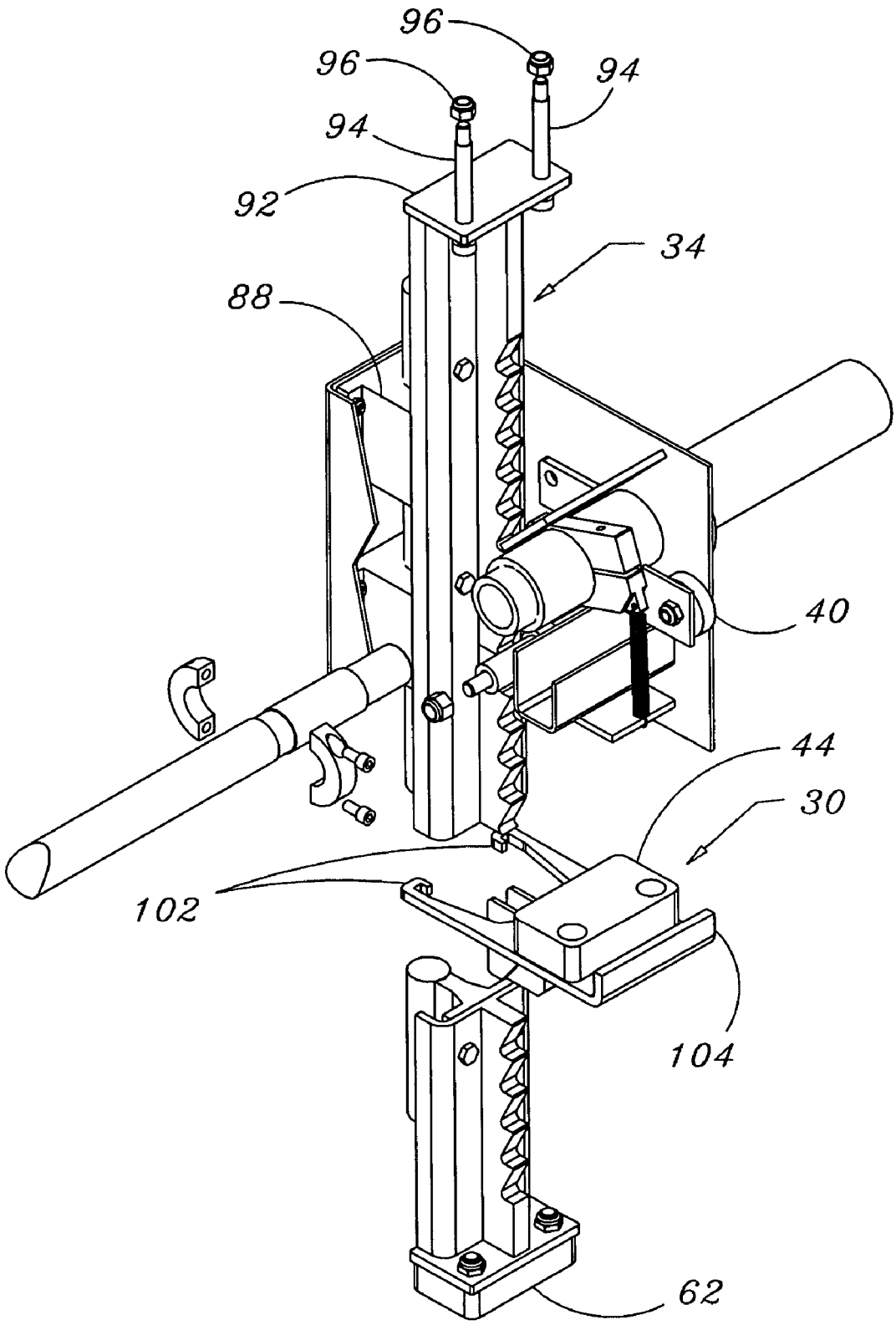
FIG. 9 is a partial isometric view of one linear component of a side frame with the handle bar displaced and one side of the lock frame substantially removed to show the internal structure of a safety lock, the lock produced in accordance with the present invention.

With one pawl engaged with the rack 34, the weight of the mechanism, handle bar and more importantly any weight plate, is transferred through the pawl 36 to the rack 34 and to the bottom of the frame 20. If the weight is dropped this impulse to the tooth of the rack 34 can be substantial given a potentially high acceleration of stopping the weight from falling. The acceleration is educed by allowing a cushioned support of the rack 34 on the frame 20 in the form of the base spring 62. This can significantly reduce stress on the mechanism. In order for this to be effective, the rack 34 must be allowed to move vertically a small amount. This is accomplished by providing an upper plate 92 on the top portion of the linear component 22 with holes to receive shoulder bolts 94 that are fastened to the upper portion of the side frame 20 by locknuts 96. The shoulder of the shoulder bolt 94 acts as a guide to allow some vertical movement of the rack 34 when the base spring 62 is compressed under load. This is also illustrated in an isometric view in FIG. 9 with the frame structure removed.

The bumper stop 30 is also shown in this view in its preferred embodiment. In this form the bumper stop 30 has a pawl tip 98 that is selectively engaged with a tooth of the rack 34. The cushion 44 is used to dampen the impact of a dropped load in a manner similar to that described for the base spring 62. The cushion 44 is mounted to the top plate 100, which includes an attachment hook 102 to secure it to the linear component 22. A back plate 104 rests against the first vertical tube 38. When a high load is applied to the bumper stop 30, the moment created to rotate the stop 30 (clockwise in this view) is countered by the reaction forces by both the attachment hooks 102 against the vertical component 22 and the back plate against the tube 38. The combination of both structures (102 and 104) to distribute the load greatly increases the strength of the stop 30.

Figure 10:
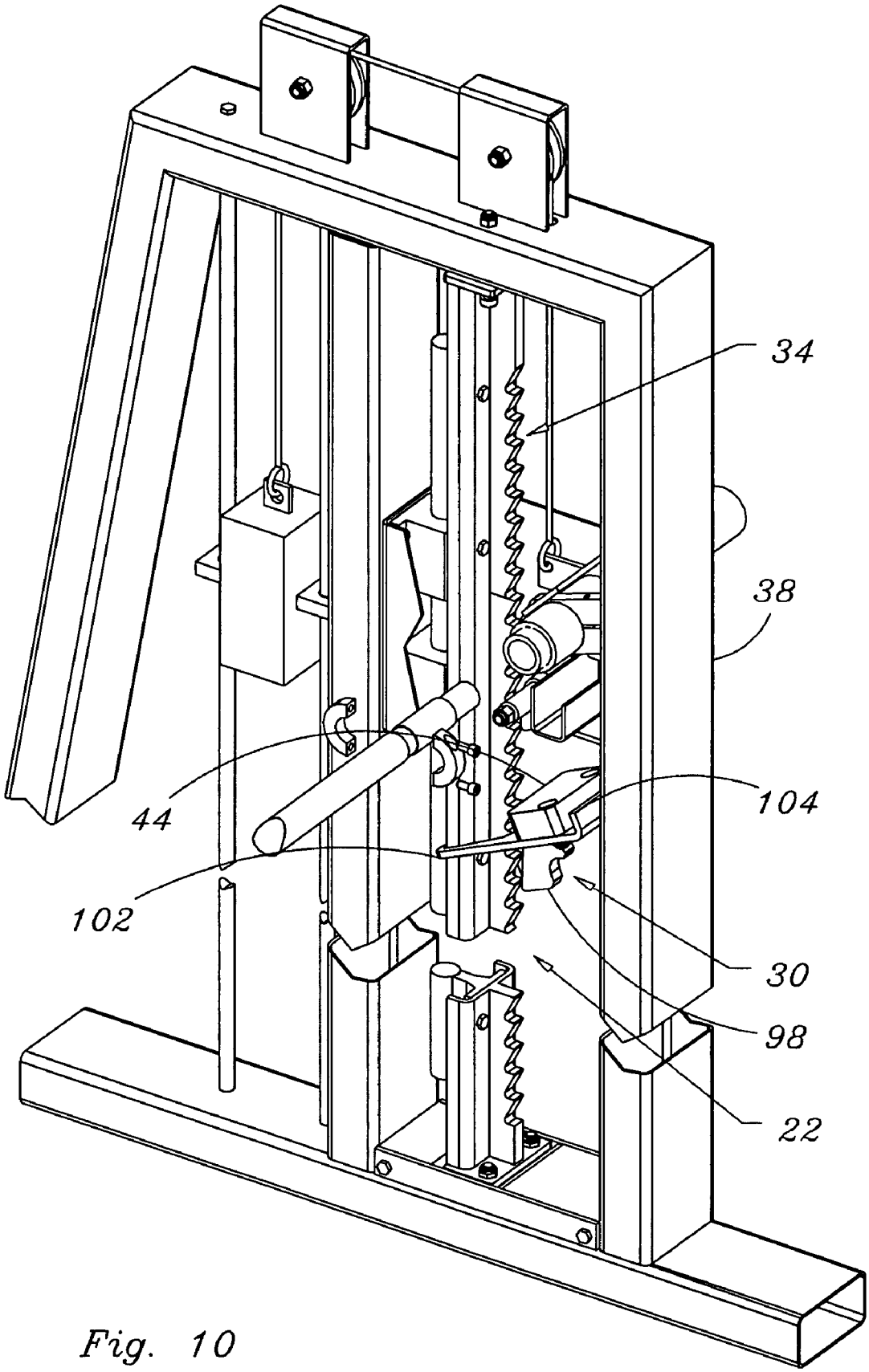
FIG. 10 is a partial isometric view of one side frame with the handle bar displaced and one side of the lock frame substantially removed to show the internal structure of an exercise device with a safety lock showing the bumper stop oriented to be vertically adjusted, the lock produced in accordance with the present invention.

The adjustment of the bumper stop 30 is illustrated in FIG. 10. The bumper stop 30 is preferably able to be adjusted at any position along the linear component 22. It is also preferable that the bumper stop 30 not be able to be removed by a user. That way the stops 30 are always on the machine and cannot get lost. This is addressed by use of a pivoting adjustment. The stop 30 is elevated on the back portion by the user and pivoted about the attachment hooks 102 at the opposite end of the stop 30. This releases the pawl tip 98 from the rack 34 and allows it to be freely moved up or down the linear component 22. When released by the user, the weight of the stop 30 will cause it to fall. This will cause the pawl tip 98 to engage with a tooth on the rack 34 and the back plate 104 to rest against the tube 38, thus locking it into place until it is moved again.

Figure 11:
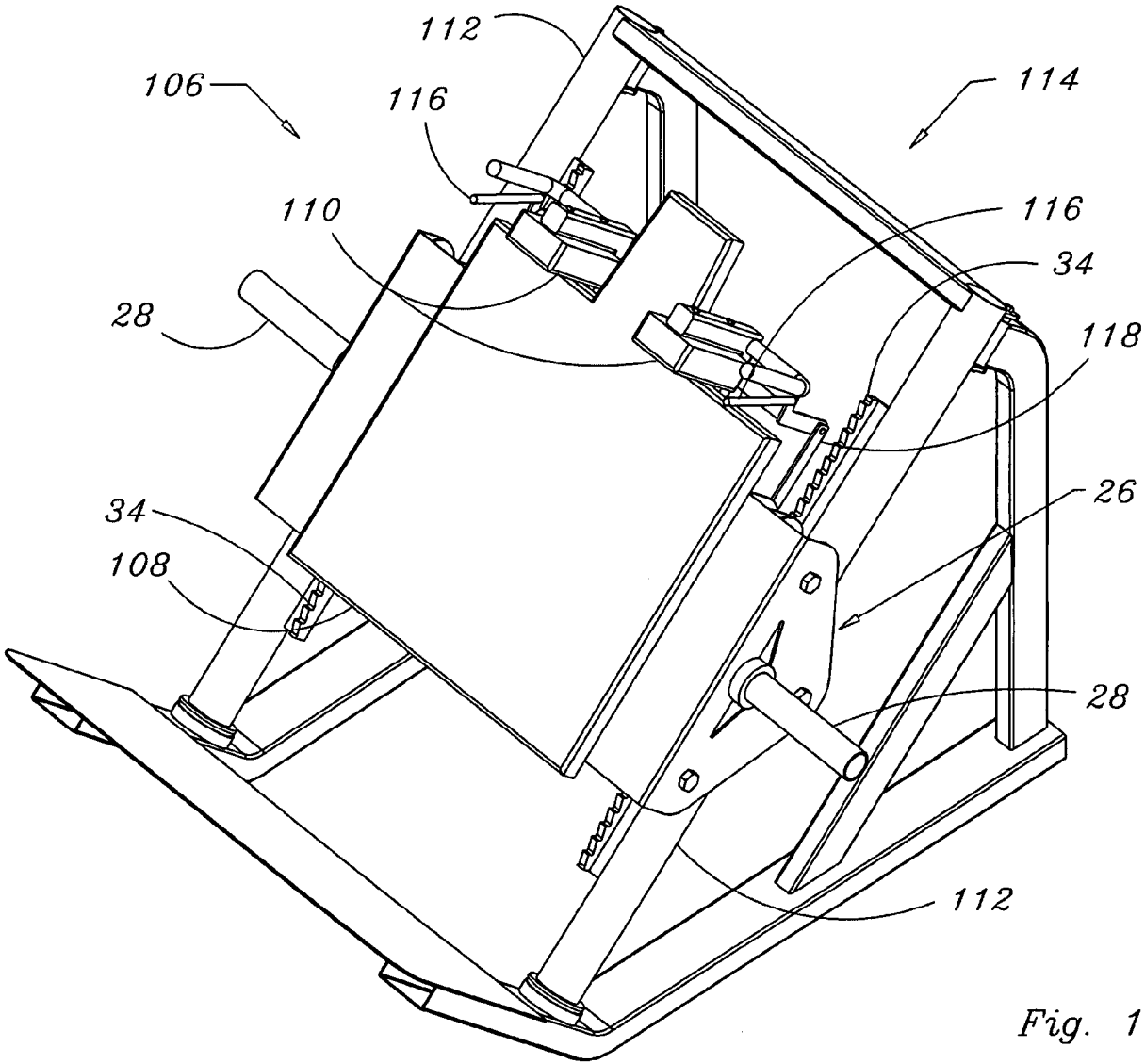
FIG. 11 is an isometric view of an exercise device of an alternative form, the exercise device including a safely lock produced in accordance with the present invention.

An alternative form of the invention is shown in FIG. 11. A hack squat machine 106 is shown as it could be made incorporating the present invention. The hack squat 106 includes a seat back 108 and a pair of shoulder pads 110. The rack 34 is similar to that as previously disclosed. The track is now comprised of a frame tube 112 that acts as a structural component of the frame 114 and a track on which the lock frame 26 can travel. The handles 116 are now remotely operated from the pawl shaft 54 (not shown) by a push bar 118. As before, weight collars 28 are provided to allow weight plates to be placed on the machine to increase the workload of the exercise.

Figure 12:
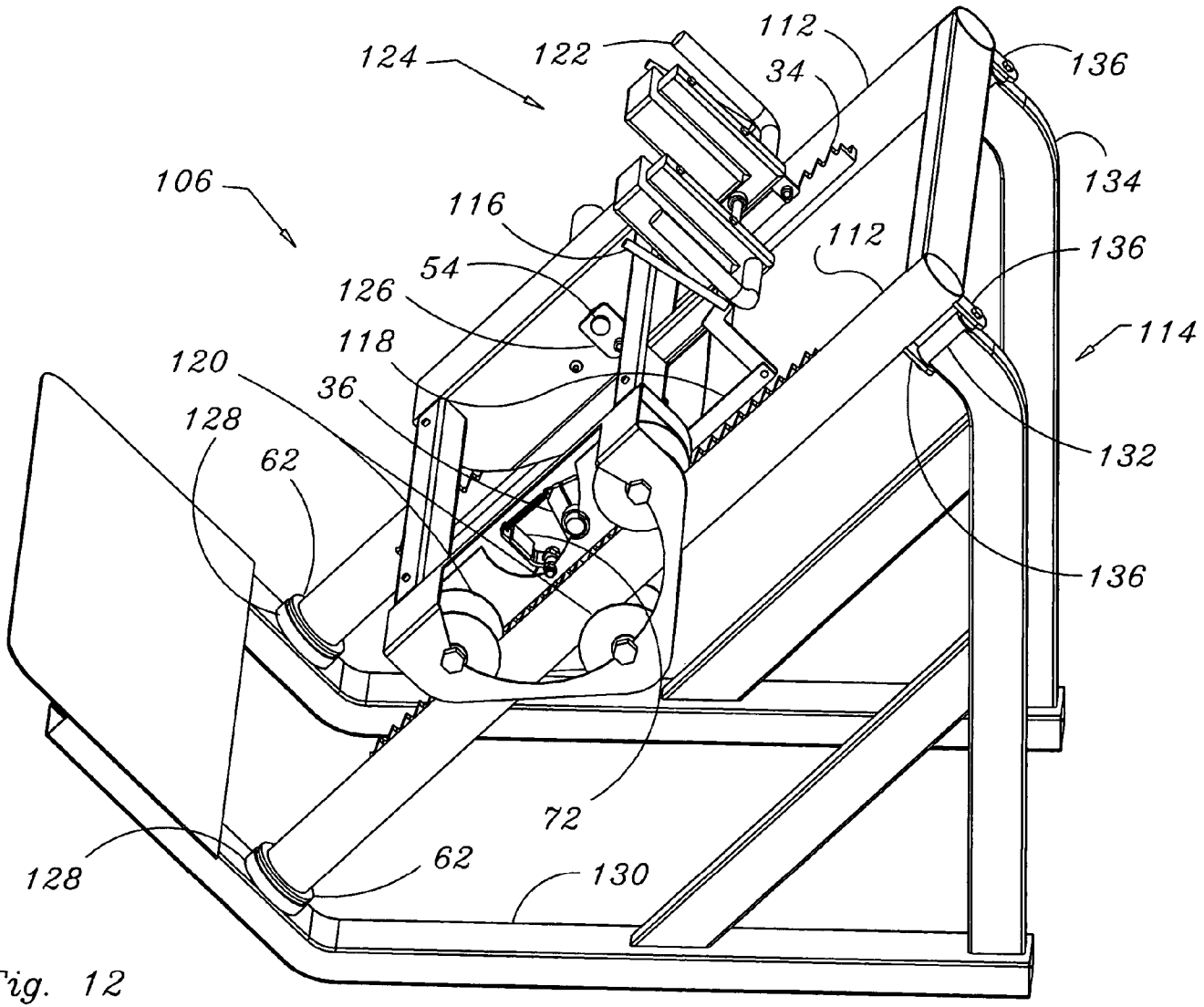
FIG. 12 is an elevated side view of an exercise device with the back pad removed and the one of the side frames partially removed to show the internal structure of a safety lock, the lock produced in accordance with the present invention.

An elevated side view of the machine 106 with the seat back 108 removed and a portion of the lock frame 26 removed is shown in FIG. 12. The guide members are comprised of a set of carriage rollers 120, which receive the track. In this version, the carriage rollers 120 capture and roll on the frame tube 112. This combination guides the lock frame 26 along the tubes 112. The rack 34 is rigidly mounted to the frame tube 112 and the first pawl 36 is connected to the pawl shaft 54 to allow rotational movement of the first pawl 36 to engage and disengage with the rack 34. A handle 116 is located near the support handles 122 on the upper portion of the carriage 124. Rotation of the handle 116 pushes down on a push bar 118. This rotates a pawl ear 126 that is rigidly mounted to the pawl shaft 54. As previously noted, rotation of pawl shaft results in rotation of the first pawl 34 to selectively engage or disengage it from the rack 34.

This version of the invention may also utilize the cushioned effect of the track (frame tube 112) on the frame. This is accomplished by a base spring 62, this time in a circular shape, which is received by a base cup 128 secured to the base 130 of the frame 114. The linear movement of the frame tube 112 is provided by a support tube 132 mounted to the rear frame members 134. The frame tubes 112 include a pair of ears 136, which support a shaft (not seen) received by the support tube 132. This allows for displacement of the frame tube 112 relative to the base 130, thereby enabling the base spring 62 to cushion a high impact load.

Figure 13:
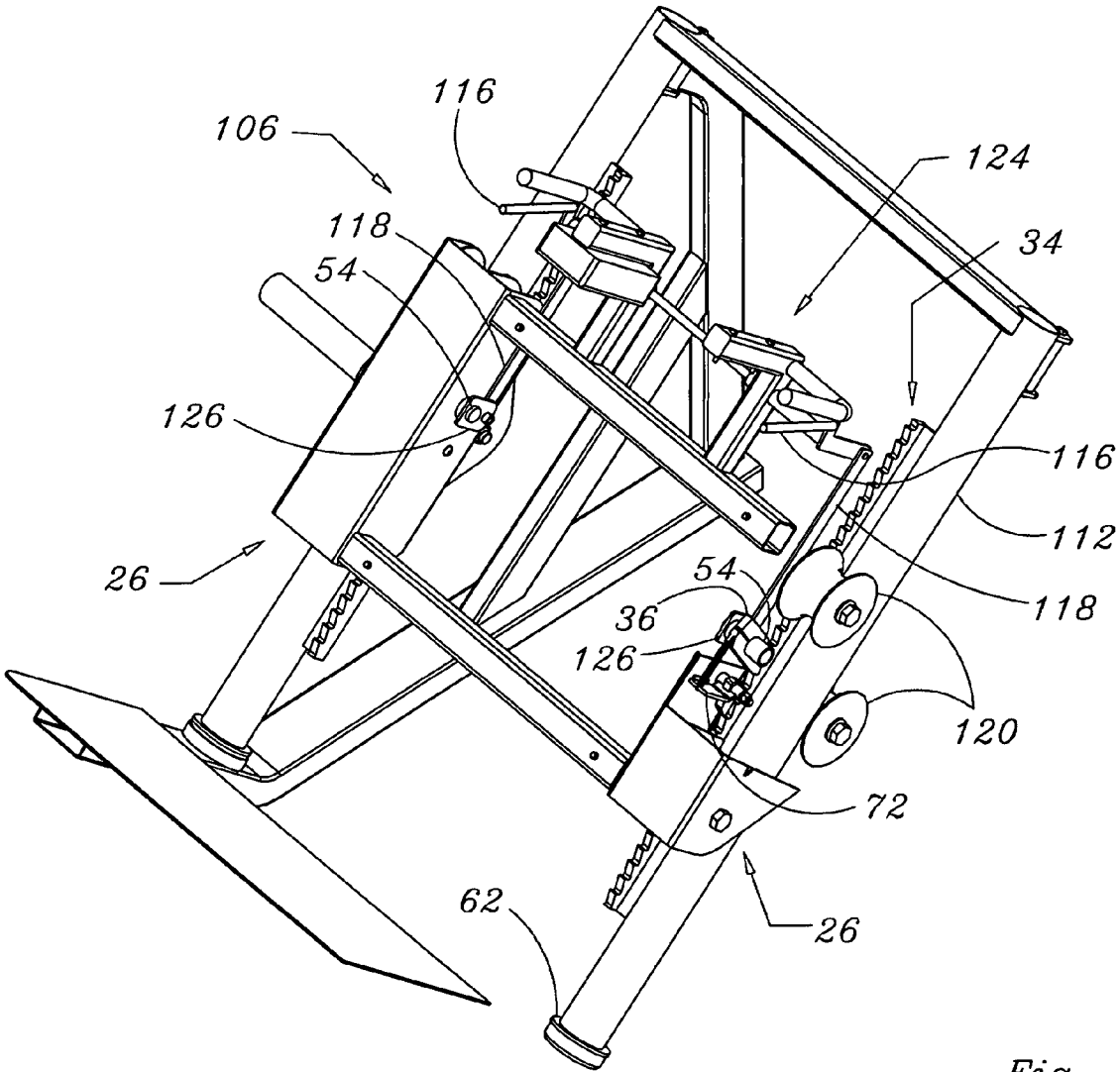
FIG. 13 is a partial isometric view of an exercise device with the back pad and a side frame removed and the one of the lock frames partially removed to show the primary pawl engaged and the secondary pawl disengaged, the lock produced in accordance with the present invention.
Figure 14:
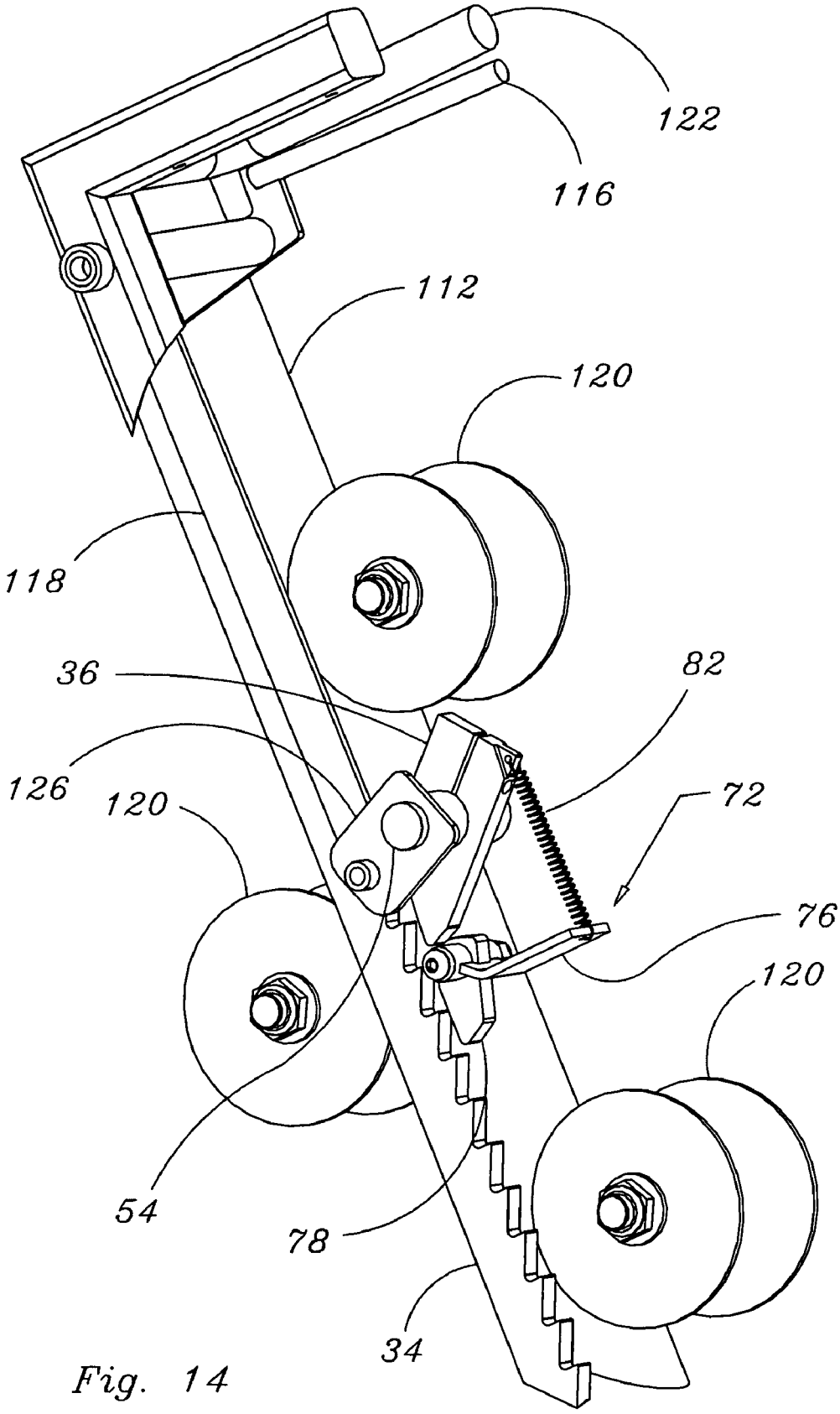
FIG. 14 is a partial isometric view of a linear component including a frame tube, rollers and the lock mechanism of a safety lock with the primary pawl and the secondary pawl disengaged, the lock produced in accordance with the present invention.

An isometric partial view of the hack squat 106 is shown in FIG. 13 and a close up view of the locking mechanism without the lock frame 26 is shown in FIG. 14. Both views show the carriage rollers 120 functioning as the guide members on the track or, in this embodiment, the frame tube 112. FIG. 13 shows the handle in a relaxed position thereby placing the first pawl 36 in a locked position in that it is engaged with the rack 34. Again, this allows the carriage 124 to move up the incline, but not down the incline of the frame tube 112. The second pawl 72 is again mounted below the first pawl 36, with a spring bias 82 providing a moment to actuate the first pawl to engage the rack 34 as well as supporting the second pawl from falling and thereby engaging the pawl tip 78 of the second pawl 72 with the rack 34. A stop is incorporated into the lock frame 26 to limit the upward rotation of the second pawl 72 toward the first pawl 36. This uppermost position is as shown in FIG. 14, only the lock frame has been removed to better show the mechanism.

In FIG. 14 the handle 116 has been rotated up toward the support handle 122 as it would be when the device is in use. The rotation of the handle 116 moves the push bar 118. The push bar 118 is pivotally mounted to the pawl ear 126, which is rigidly mounted to the pawl shaft 54. The pawl shaft 54 is mounted to the first pawl 36, which is then displaced away from the rack 34 in an unlocked position. In that the spring 82 is still in tact, the second pawl 72 is elevated and maintained in its unlocked position. Therefore with both pawls unlocked, the lock frame 26, as part of the carriage, is free to move up and down the track (frame tube 112). If the handle 116 is released by the user, the first pawl 36 engages with the rack 34. Also if the spring 82 breaks or becomes disassociated with either the first pawl 36 or the second pawl 72, the second pawl will fall due to the weight of the counterbalance plate 76, placing the pawl tip 78 in the rack 34 as previously disclosed, thereby locking the lock frame 26 to be able to move up but not down the track.

The invention as shown and described herein is the preferred embodiment of the invention as seen by the inventor. It is understood that an infinite number of variations of certain details are possible and therefore are inherently included in this disclosure.

What is claimed is:

1. An exercise device comprising:

a frame supporting a track and a load rack;

a lock frame supporting a guide member, said track received by said guide member;

a pawl shaft articulated by a handle and said pawl shaft received by said lock frame;

a first pawl mounted to said pawl shaft, thereby enabling selective engagement and disengagement of said first pawl with said load rack by way of said handle;

a second pawl movably mounted to said lock frame; and a bias mechanism connecting said first pawl to said second pawl.

2. The exercise device as in claim 1, wherein said load rack is a notched rack.

3. The exercise device as in claim 2, wherein said notched rack is comprised of a plurality of saw-toothed notches.

4. The exercise device as in claim 1, wherein said track is a track selected from a group consisting of a shaft a tube.

5. The exercise device as in claim 1, wherein said guide member is a device selected from the group consisting of a linear bearing, a bushing and a rolling element.

6. The exercise device as in claim 5, wherein said rolling element includes a wheel, ball bearing and a carriage roller.

7. The exercise device as in claim 1, wherein said handle is a substantially longitudinal bar substantially collinear with said pawl shaft.

8. The exercise device as in claim 1, wherein said pawl shaft is articulated by said handle by way of a push bar.

9. The exercise device as in claim 1, wherein said bias mechanism is comprised of a spring.

10. The exercise device as in claim 9, wherein said spring is an extension spring.

11. The exercise device as in claim 1, wherein said load rack is movably mounted to said frame.

12. The exercise device as in claim 11, wherein said exercise device further includes a base spring at least partially supporting said rack on said frame.

13. The exercise device as in claim 12, wherein said base spring is comprised of a compression spring.

14. The exercise device as in claim 13, wherein said compression spring is manufactured from a material consisting of plastic, metal, natural rubber and synthetic rubber.

15. The exercise device as in claim 13, wherein said base spring is a polyurethane bumper pad.

16. The exercise device as in claim 1, wherein said second pawl is counterbalanced such that, in a relaxed state, said second pawl is engaged with said rack.

17. The exercise device as in claim 1, wherein said bias member holds said second pawl in a position disengaged from said rack.

18. The exercise device as in claim 1, further comprising a bumper stop releasably mounted to said rack.

19. The exercise device as in claim 18, wherein said bumper stop is movably mounted to said rack along a portion of the length of said rack.

20. The exercise device as in claim 1, wherein said lock frame includes a tension member connected to a counterweight.

21. The exercise device as in claim 1, said second pawl further comprising in combination:

a counterbalance plate; and a pawl portion, the combination pivotally mounted to said lock frame.

22. The exercise device as in claim 1, said lock frame further comprising an upper stop plate enabling a movement boundary of said first pawl in an unlocked state.

23. The exercise device including a load rack and a substantially linear track received by a guide member which is supported by a lock frame, the exercise device including a safety locking device comprising:

a pawl shaft articulated by a handle and said pawl shaft received by said lock frame;

a first pawl mounted to said pawl shaft, thereby enabling selective engagement and disengagement of said first pawl with said load rack by way of said handle;

a second pawl movably mounted to said lock frame; and a bias mechanism connecting said first pawl to said second pawl.

24. The exercise device as in claim 23, wherein said load rack is a notched rack.

25. The exercise device as in claim 24, wherein said notched rack is comprised of a plurality of saw-toothed notches.

26. The exercise device as in claim 23, wherein said track is a track selected from a group consisting of a shaft a tube.

27. The exercise device as in claim 23, wherein said guide member is a device selected from the group consisting of a linear bearing, a bushing and a rolling element.

28. The exercise device as in claim 27, wherein said rolling element includes a wheel, ball bearing and a carriage roller.

29. The exercise device as in claim 23, wherein said handle is a substantially longitudinal bar substantially collinear with said pawl shaft.

30. The exercise device as in claim 23, wherein said pawl shaft is articulated by said handle by way of a push bar.

31. The exercise device as in claim 23, wherein said bias mechanism is comprised of a spring.

32. The exercise device as in claim 31, wherein said spring is an extension spring.

33. The exercise device as in claim 23, wherein said load rack is movably mounted to said frame.

34. The exercise device as in claim 33, wherein said exercise device further includes a base spring at least partially supporting said rack on said frame.

35. The exercise device as in claim 34, wherein said base spring is comprised of a compression spring.

36. The exercise device as in claim 35, wherein said compression spring is manufactured from a material consisting of plastic, metal, natural rubber and synthetic rubber.

37. The exercise device as in claim 35, wherein said base spring is a polyurethane bumper pad.

38. The exercise device as in claim 23, wherein said second pawl is counterbalanced such that, in a relaxed state, said second pawl is engaged with said rack.

39. The exercise device as in claim 23, wherein said bias member holds said second pawl in a position disengaged from said rack.

40. The exercise device as in claim 23, further comprising a bumper stop releasably mounted to said rack.

41. The exercise device as in claim 40, wherein said bumper stop is movably mounted to said rack along a portion of the length of said rack.

42. The exercise device as in claim 23, wherein said lock frame includes a tension member connected to a counterweight.

43. The exercise device as in claim 23, further comprising a weight collar adapted to receive weight plates, the collar mounted to said lock frame.

44. The exercise device as in claim 23, the second pawl further comprising in combination:

a counterbalance plate; and a pawl portion, the combination pivotally mounted to said lock frame.

45. The exercise device as in claim 23, further comprising an upper stop plate mounted to said lock frame for enabling a movement boundary of said first pawl in an unlocked state.

46. A method of exercise for use with exercise device including a load rack and a substantially linear track received by a guide member which is supported by a lock frame, the exercise device including a safety locking device including a pawl shaft articulated by a handle and said pawl shaft received by said lock frame; a first pawl mounted to said pawl shaft, thereby enabling selective engagement and disengagement of said first pawl with said load rack by way of said handle; a second pawl movably mounted to said lock frame; and a bias mechanism connecting said first pawl to said second pawl, the method of exercise including the steps of:

grasping said handle by a user;

articulating said handle to disengage said first pawl from said rack; and moving said lock frame thereby exercising the muscles of the user.

47. The method of exercise as in claim 46, further including the step of:

adding a weight plate to said lock frame.

48. A method of using a safety lock on an exercise device of the type including a load rack and a substantially linear track received by a guide member which is supported by a lock frame, the exercise device including a safety locking device including a pawl shaft articulated by a handle and said pawl shaft received by said lock frame; a first pawl mounted to said pawl shaft, thereby enabling selective engagement and disengagement of said first pawl with said load rack by way of said handle; a second pawl movably mounted to said lock frame; and a bias mechanism connecting said first pawl to said second pawl, the method including:

providing said bias member to become disconnected from either of said first pawl or said second pawl; and allowing said second pawl to engage with said rack, thereby limiting movement of said lock frame in at least one direction.

* * * * *